US010415157B2

(12) United States Patent
Matsubara et al.

(10) Patent No.: US 10,415,157 B2
(45) Date of Patent: Sep. 17, 2019

(54) ECCENTRIC HOLLOW CONJUGATED CONTINUOUS FIBER, CONTINUOUS-FIBER NONWOVEN FABRIC MADE THEREFROM AND USES THEREOF

(75) Inventors: Akio Matsubara, Ichihara (JP); Kenichi Suzuki, Ichihara (JP); Shigeyuki Motomura, Chiba (JP)

(73) Assignee: MITSUI CHEMICALS, INC., Minato-Ku, Tokyo (JP)

( * ) Notice: Subject to any disclaimer, the term of this patent is extended or adjusted under 35 U.S.C. 154(b) by 771 days.

(21) Appl. No.: 12/742,492

(22) PCT Filed: Nov. 12, 2008

(86) PCT No.: PCT/JP2008/070561

§ 371 (c)(1),
(2), (4) Date: May 12, 2010

(87) PCT Pub. No.: WO2009/063889

PCT Pub. Date: May 22, 2009

(65) Prior Publication Data

US 2010/0292662 A1 Nov. 18, 2010

(30) Foreign Application Priority Data

Nov. 12, 2007 (JP) ..... 2007-293764

(51) Int. Cl.
*D01F 8/06* (2006.01)
*D01D 5/24* (2006.01)
(Continued)

(52) U.S. Cl.
CPC ..... *D01F 8/06* (2013.01); *D01D 5/24* (2013.01); *D01F 8/04* (2013.01); *D04H 3/018* (2013.01);
(Continued)

(58) Field of Classification Search
CPC . A61F 13/15; D01D 5/24; D01D 5/30; D01D 5/32; Y10T 428/24; Y10T 428/2909; Y10T 428/2931; D01F 8/06
(Continued)

(56) References Cited

U.S. PATENT DOCUMENTS 5,272,023 A * 12/1993 Yamamoto et al. ..... 428/198
5,695,376 A * 12/1997 Datta et al. ..... 442/334
(Continued)

FOREIGN PATENT DOCUMENTS

EP 1 452 633 A1 9/2004
JP 63-264915 A 11/1988
(Continued)

OTHER PUBLICATIONS

Supplementary European Search Report dated Dec. 9, 2011, issued in the corresponding European Patent Application No. 08848662.6.
International Search Report for PCT/JP2008/070561 completed Jan. 5, 2009.

*Primary Examiner* — Peter Y Choi
(74) *Attorney, Agent, or Firm* — Buchanan, Ingersoll & Rooney PC

(57) ABSTRACT

There is provided a continuous-fiber nonwoven fabric excellent in terms of bulkiness, flexibility, and shape stability. The continuous-fiber nonwoven fabric comprises eccentric hollow conjugated continuous fiber containing a part (A), a part containing a higher melting-point thermoplastic resin (A), and a part (B), a part containing a lower melting-point thermoplastic resin (B), the parts (A) and (B) having been bonded to each other in a side by side arrangement, wherein the difference in melting point between the higher melting-point thermoplastic resin (A) and the lower melting-point thermoplastic resin (B) is 5° C. or greater, the eccentric hollow conjugated continuous fiber has a part (A):part (B) proportion in the range of 5 to 30 weight %:95 to 70 weight
(Continued)

%, the eccentric hollow conjugated continuous fiber has a cross-section in which the thickness (a) of the part (A) is smaller than the thickness (b) of the part (B), and the eccentric hollow conjugated continuous fiber has been crimped.

20 Claims, 5 Drawing Sheets

(51) Int. Cl.
*D01F 8/04* (2006.01)
*D04H 3/14* (2012.01)
*D04H 3/018* (2012.01)
*D04H 3/147* (2012.01)

(52) U.S. Cl.
CPC ..... *D04H 3/14* (2013.01); *D04H 3/147* (2013.01); *Y10T 428/2931* (2015.01); *Y10T 442/612* (2015.04)

(58) Field of Classification Search
USPC ..... 442/327, 311, 361; 428/374
See application file for complete search history.

(56) References Cited

U.S. PATENT DOCUMENTS

| | | | | |
|---|---|---|---|---|
| 6,454,989 | B1 | 9/2002 | Neely et al. | |
| 2004/0067709 | A1* | 4/2004 | Kishine et al. | 442/327 |
| 2005/0221709 | A1* | 10/2005 | Jordan | D01F 8/06 442/328 |
| 2006/0121812 | A1* | 6/2006 | Suzuki et al. | 442/411 |
| 2007/0014987 | A1* | 1/2007 | Usui | D01F 8/06 428/375 |

FOREIGN PATENT DOCUMENTS

| | | | | |
|---|---|---|---|---|
| JP | 01-213452 | A | 8/1989 | |
| JP | 02-191718 | A | 7/1990 | |
| JP | 5-263344 | A | 10/1993 | |
| JP | 10-110372 | A | 4/1998 | |
| JP | 10-195750 | A | 7/1998 | |
| JP | 2002-529617 | A | 9/2002 | |
| JP | WO 2005021850 | A1 * | 3/2005 | D01F 8/06 |
| WO | WO 00/28123 | A1 | 5/2000 | |
| WO | WO 03/056077 | A1 | 7/2003 | |
| WO | WO 2005/001175 | A1 | 1/2005 | |

* cited by examiner

[Fig.1]
Fig. 1-1
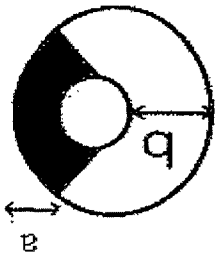
Fig. 1-2
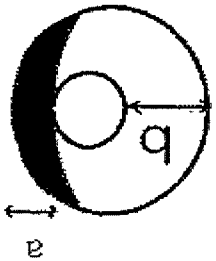
Fig. 1-3
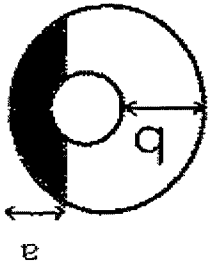
Fig. 1-4
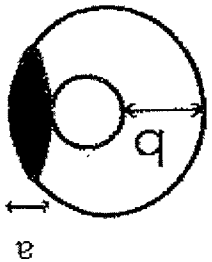
Fig. 1-5
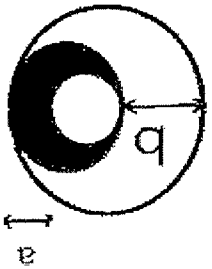
[Fig.2]
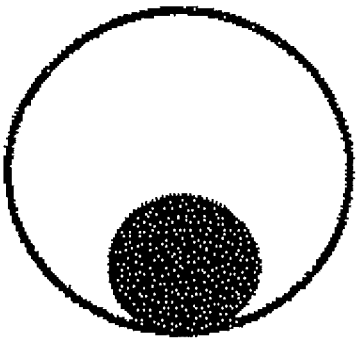

[Fig.3]
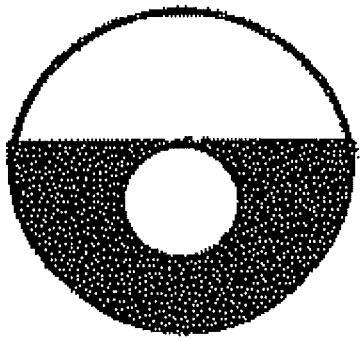
[Fig.4]
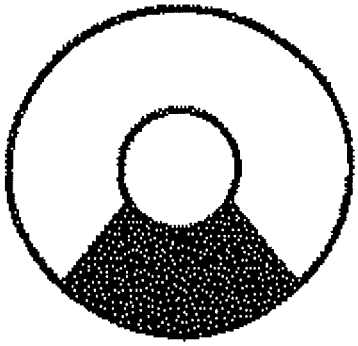
[Fig.5]
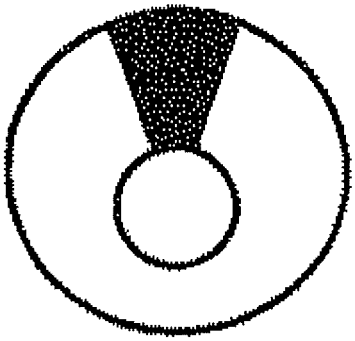

[Fig.6]
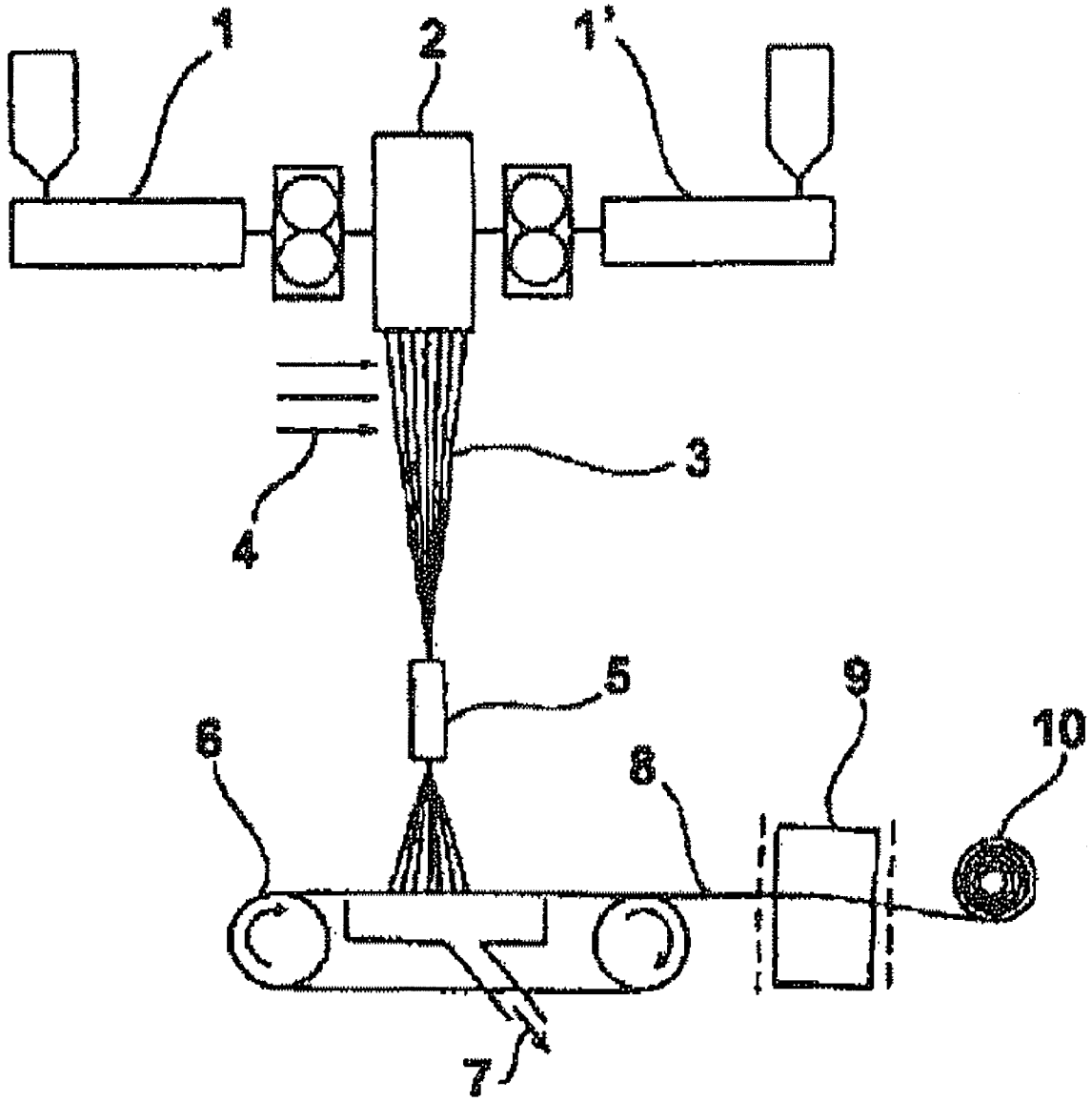

[Fig.7]
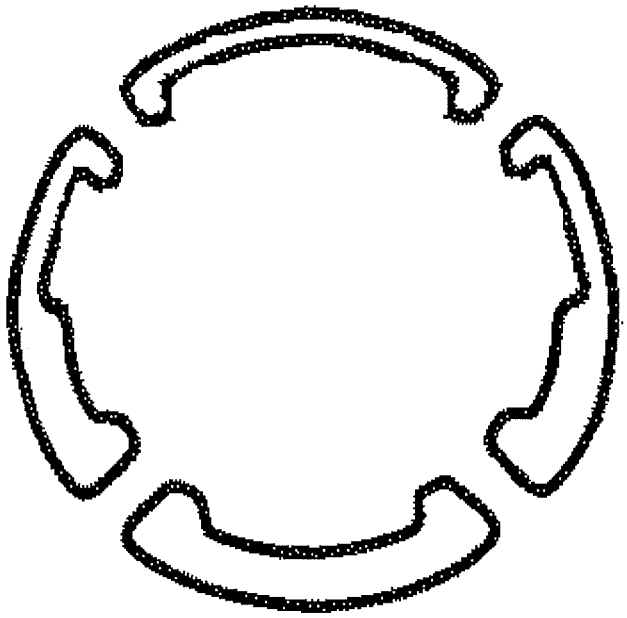
[Fig.8]
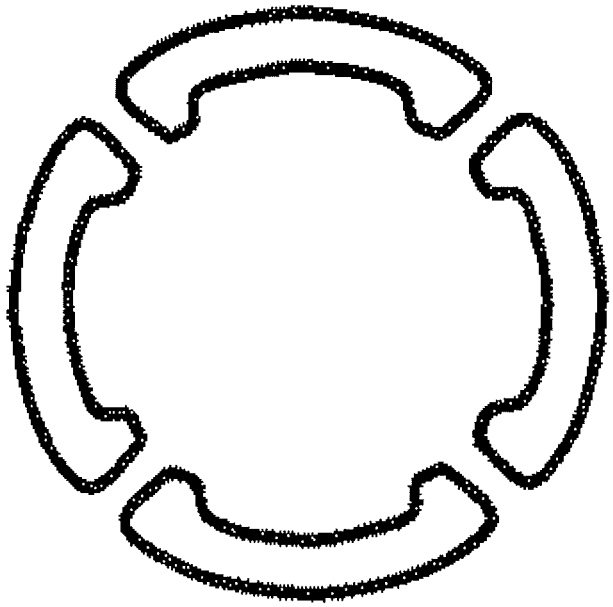

[Fig.9]
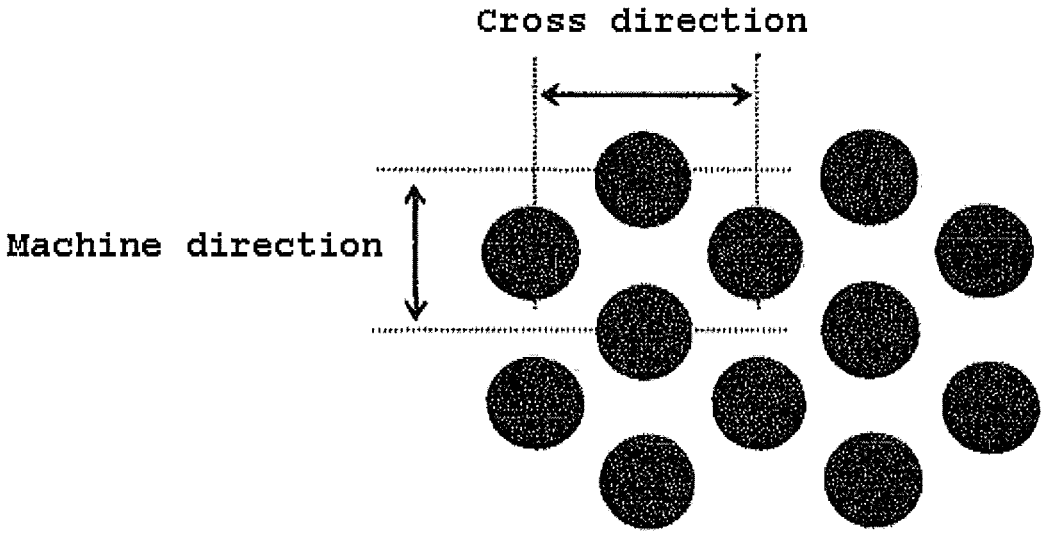

ECCENTRIC HOLLOW CONJUGATED CONTINUOUS FIBER, CONTINUOUS-FIBER NONWOVEN FABRIC MADE THEREFROM AND USES THEREOF

TECHNICAL FIELD

The present invention relates to an eccentric hollow conjugated continuous fiber suitable to obtain a continuous-fiber nonwoven fabric excellent in terms of bulkiness, flexibility, and shape stability, a continuous-fiber nonwoven fabric made therefrom, and the uses thereof.

BACKGROUND ART

Recently, nonwoven fabric has been used in a wide variety of applications because of its excellent air permeability and flexibility. Thus, nonwoven fabric is required to have various properties so as to be suitable to its applications and is demanded to have such properties improved.

For example, nonwoven fabrics for paper diapers, sanitary napkins, and other hygienic materials or for base sheets of poultice materials are required to be water resistance and excellent in terms of moisture permeability. Furthermore, some kinds of nonwoven fabrics are required to be extensibility because of their application sites.

To improve the touch and drape of nonwoven fabric, it is effective that the nonwoven fabric is bulky. As a solution to this, many methods have been proposed with approaches in which core-in-sheath or side by side conjugated continuous fiber made of different kinds of polymers is used so that filaments contained in nonwoven fabric are crimpy.

For example, Japanese Unexamined Patent Application Publication No. H10-110372 (Patent Document 1) has proposed a method including the use of a hollow conjugated continuous fiber; this method uses a side by side conjugated continuous fiber that has a hollow and comprises at least two resins having a side by side arrangement and having a melting point difference between the resins of 15° C. or greater.

As another example, National Publication of International Patent Application No. 2002-529617 (Patent Document 2) has proposed a method including the use of a hollow continuous multicomponent fiber comprising different kinds of propylene polymers and other related embodiments.

Then, Examples described in Patent Documents 1 and 2 independently include a method including the use of a hollow conjugated continuous fiber having two components at 50/50.

Furthermore, Patent Document 2 has proposed a hollow conjugated continuous fiber having an eccentric hollow [FIG. 3D in Patent Document 2].

The methods proposed in Patent Documents 1 and 2 give a crimped conjugated continuous fiber; however, continuous-fiber nonwoven fabric that is more excellent in terms of bulkiness may be needed in some applications.

[Patent Document 1] Japanese Unexamined Patent Application Publication No. H10-110372

[Patent Document 2] National Publication of International Patent Application No. 2002-529617

DISCLOSURE OF INVENTION

Problems to be Solved by the Invention

An object of the present invention is to provide an eccentric hollow conjugated fiber suitable to obtain a continuous-fiber nonwoven fabric excellent in terms of bulkiness, flexibility, and shape stability, and a continuous-fiber nonwoven fabric.

Means for Solving the Problems

The present invention is an eccentric hollow conjugated continuous fiber that contains a part (A), a part containing a higher melting-point thermoplastic resin (A), and a part (B), a part containing a lower melting-point thermoplastic resin (B), the parts (A) and (B) having been bonded to each other in a side by side arrangement, wherein the difference in melting point between the higher melting-point thermoplastic resin (A) and the lower melting-point thermoplastic resin (B) is 5° C. or greater, the eccentric hollow conjugated continuous fiber has a part (A):part (B) proportion in the range of 5 to 30 weight %:95 to 70 weight %, the eccentric hollow conjugated continuous fiber has a cross-section in which the thickness (a) of the part (A) is smaller than the thickness (b) of the part (B), and the eccentric hollow conjugated continuous fiber has been crimped.

Additionally, the present invention is a continuous-fiber nonwoven fabric comprising an eccentric hollow conjugated continuous fiber comprising a part (A), a part containing a higher melting-point thermoplastic resin (A), and a part (B), a part containing a lower melting-point thermoplastic resin (B), the parts (A) and (B) having been bonded to each other in a side by side arrangement, wherein the difference in melting point between the higher melting-point thermoplastic resin (A) and the lower melting-point thermoplastic resin (B) is 5° C. or greater, the eccentric hollow conjugated continuous fiber has a part (A):part (B) proportion in the range of 5 to 30 weight %:95 to 70 weight %, the eccentric hollow conjugated continuous fiber has a cross-section in which the thickness (a) of the part (A) is smaller than the thickness (b) of the part (B), and the eccentric hollow conjugated continuous fiber has been crimped.

Additionally, the present invention is a mixed continuous-fiber nonwoven fabric comprising a mixture of an eccentric hollow conjugated continuous fiber and a non-crimped continuous fiber, the eccentric hollow conjugated continuous fiber comprising a part (A), a part containing a higher melting-point thermoplastic resin (A), and a part (B), a part containing a lower melting-point thermoplastic resin (B), the parts (A) and (B) having been bonded to each other in a side by side arrangement, wherein the difference in melting point between the higher melting-point thermoplastic resin (A) and the lower melting-point thermoplastic resin (B) is 5° C. or greater, the eccentric hollow conjugated continuous fiber has a part (A):part (B) proportion in the range of 5 to 30 weight %:95 to 70 weight %, the eccentric hollow conjugated continuous fiber has a cross-section in which the thickness (a) of the part (A) is smaller than the thickness (b) of the part (B), and the eccentric hollow conjugated continuous fiber has been crimped.

Effect of the Invention

The eccentric hollow conjugated continuous fiber, continuous-fiber nonwoven fabric, mixed-continuous-fiber nonwoven fabric, and continuous-fiber nonwoven fabric laminate according to the present invention are excellent in terms of bulkiness, flexibility, and shape stability.

Furthermore, paper diapers, sheets for barrier leg cuff, and sanitary napkins made using the eccentric hollow conjugated continuous fiber, continuous-fiber nonwoven fabric, mixed-continuous-fiber nonwoven fabric, or a laminate of the continuous-fiber nonwoven fabrics according to the present invention have excellent and well-balanced bulkiness (touch and drape), flexibility, lint-free performance, and shape stability.

BRIEF DESCRIPTION OF THE DRAWINGS

FIG. 1 includes schematic diagrams each showing an exemplary cross-section of eccentric hollow conjugated continuous fiber used in an example of the present invention.

Five cross-section shapes, FIGS. 1-1 to 1-5, are shown. In these drawings, the white and black areas represent resins used in combination, a represents the thickness of the part (A), and b represents the thickness of the part (B).

FIG. 2 is a schematic diagram showing a cross-section of crimped conjugated continuous fiber used in a comparative example of the present invention. In this drawing, the white and black areas represent resins used in combination.

FIG. 3 is a schematic diagram showing a cross-section of eccentric hollow conjugated continuous fiber used in a comparative example of the present invention. In this drawing, the white and black areas represent resins used in combination.

FIG. 4 is a schematic diagram showing a cross-section of hollow conjugated continuous fiber used in a comparative example of the present invention. In this drawing, the white and black areas represent resins used in combination.

FIG. 5 is a schematic diagram showing a cross-section of hollow conjugated continuous fiber used in a comparative example of the present invention. In this drawing, the white and black areas represent resins used in combination.

FIG. 6 is an overview of the spunbonding apparatus used in examples and comparative examples of the present invention.

FIG. 7 is a schematic diagram showing the slit arrangement of the spinneret for eccentric hollow conjugated continuous fiber used in examples of the present invention. In these examples of the present invention, the higher melting-point resin (A) was discharged through the portions with a narrower slit width.

FIG. 8 is a schematic diagram showing the slit arrangement of the spinneret for concentric hollow conjugated continuous fiber used in a comparative example of the present invention.

FIG. 9 is a conceptual diagram showing the nozzle pitches of the spinnerets used in examples and comparative examples of the present invention.

BEST MODE FOR CARRYING OUT THE INVENTION

<Thermoplastic Resins>

The thermoplastic resins constituting the eccentric hollow conjugated continuous fiber according to the present invention may be any kinds of known thermoplastic resins as long as they can be spun into fiber.

Specific examples include the following:

olefin polymers such as homopolymers or copolymers of α-olefin(s) such as ethylene, propylene, 1-butene, 1-hexene, 4-methyl-1-pentene, and 1-octene, for example, ethylene polymers, such as high-pressure low-density polyethylenes, linear low-density polyethylenes (so-called LLDPE), and high-density polyethylenes;

propylene polymers, such as polypropylene (propylene homopolymer) and propylene/α-olefin random copolymers; poly(1-butene), poly(4-methyl-1-pentene), ethylene/propylene random copolymers, ethylene/1-butene random copolymers, and propylene/1-butene random copolymers;

polyesters, such as polyethylene terephthalate, polybutylene terephthalate, and polyethylene naphthalate;

polyamides, such as nylon 6, nylon 66, and polymethaxylene adipamide;

polyvinyl chloride; polyimides; ethylene/vinyl acetate copolymers; polyacrylonitrile; polycarbonates; polystyrene; ionomers; mixtures of them; and so forth.

Preferred ones of these resins include ethylene polymers, propylene polymers, polyesters, polyamides, and so forth.

The molecular weight of the thermoplastic resins is not particularly limited as long as it allows the thermoplastic resins to be melted and spun into fiber.

If necessary, the thermoplastic resins used in the present invention may each contain commonly used additives or other kinds of polymers unless this prevents the achievement of the object of the present invention.

Examples of applicable additives include antioxidants, weathering stabilizers, antistatic agents, antifog agents, antiblocking agents, lubricants, nucleating agents, pigments, and so forth.

<Higher melting-point thermoplastic resin (A)>The higher melting-point thermoplastic resin (A) contained in the part (A) of the eccentric hollow conjugated continuous fiber according to the present invention [hereinafter, sometimes referred to as the resin (A) is a resin chosen from the above-listed thermoplastic resins and has a melting point or softening point higher than that of the lower melting-point thermoplastic resin (B) contained in the part (B) [hereinafter, sometimes referred to as the resin (B)] by at least 5° C., preferably, 10° C. or more.

Note that, in the present invention, the difference between the melting point or softening point of the higher melting-point thermoplastic resin (A) and the melting point or softening point of the lower melting-point thermoplastic resin (B) is sometimes collectively referred to as the melting point difference.

For the determination of the above-described melting point difference, rules are as follows.

When the resin (A) is a thermoplastic resin that has its melting point and the resin (B) is also a thermoplastic resin that has its melting point, the difference between the melting point of the resin (A) and that of the resin (B) is defined as the melting point difference.

When the resin (A) is a thermoplastic resin that has its melting point but the resin (B) is a thermoplastic resin that has no melting point, the difference between the melting point of the resin (A) and the softening point of the resin (B) is defined as the melting point difference.

When the resin (A) is a thermoplastic resin that has no melting point but the resin (B) is a thermoplastic resin that has its melting point, the difference between the softening point of the resin (A) and the melting point of the resin (B) is defined as the melting point difference.

When the resin (A) is a thermoplastic resin that has no melting point and the resin (B) is also a thermoplastic resin that has no melting point, the difference between the softening point of the resin (A) and that of the resin (B) is defined as the melting point difference.

From the viewpoint of the strength of the eccentric hollow conjugated continuous fiber, it is preferable that two kinds of thermoplastic resins are used in combination with the difference between the melting point or softening point of the resin (A) and the melting point or softening point of the resin (B) being at least 5° C.

It is more preferable that two kinds of thermoplastic resins are used in combination with the difference between the melting point or softening point of the resin (A) and the melting point or softening point of the resin (B) being at least 10° C.

Depending on the combination of the higher melting-point thermoplastic resin (A) and the lower melting-point thermoplastic resin (B), preferable resins for the higher melting-point thermoplastic resin (A) are propylene polymers that have a melting point of at least 155° C., preferably, in the range of 157 to 165° C.

Examples of applicable propylene polymers include propylene homopolymers, propylene-based copolymers that contain one or more kinds of α-olefins (e.g., ethylene, 1-butene, 1-hexene, and 1-octene) at a low content ratio (preferably, 1 weight % or lower), and so forth; however, propylene homopolymers are particularly preferable.

Specific examples of applicable propylene polymers include polypropylene (Prime Polypro with the product name of J700GP; manufactured by Prime Polymer Co., Ltd.; melting point (Tmo): 163° C.), polypropylene (Prime Polypro with the product name of F113G; manufactured by Prime Polymer Co., Ltd.; melting point (Tmo): 163° C.), polypropylene (Novatec with the product name of SA06A; manufactured by Japan Polypropylene Corporation; melting point (Tmo): 160° C.), and so forth.

The melting point/softening point of the higher melting-point thermoplastic resin (A) used in the present invention is measured with a differential scanning calorimeter (DSC) in the following way.

First, a sample prepared by filling an aluminum pan for DSC with the higher melting-point thermoplastic resin (A) is gently placed on the position indicated on a DSC.

Then, the sample is heated until the temperature is approximately 50° C. higher than the level at which a peak value is reached on the melting endotherm curve for the heating rate of 10° C./minute, is maintained at the temperature for 10 minutes, and is then cooled to 30° C. at a cooling rate of 10° C./minute. Then, the sample is heated once again to a certain temperature at a heating rate of 10° C./minute, and the melting curve is plotted.

In accordance with the method specified in ASTM D3418-99, the temperature (Tp) at which a peak value is reached on the melting endotherm curve is determined on the melting curve obtained. The endothermic peak at the peak temperature is used as the melting point (Tmo). If no peak value is given at any temperature, the inflection point of the melting endotherm curve is defined as the softening point.

When a propylene polymer or an ethylene polymer is used in the present invention as the higher melting-point thermoplastic resin (A), the melt-flow rate (MFR) of the resin (A) is not particularly limited as long as it allows the resin (A) to be spun into fiber; however, it is usually in the range of 15 to 100 g/10 minutes, preferably, 50 to 80 g/10 minutes.

In addition, for the resin (A) being a propylene polymer, the above-described MFR is measured under its corresponding conditions in ASTM D 1238, namely, at 230° C. and with a load of 2.16 kg; for the resin (A) being a ethylene polymer, the above-described MFR is measured under its corresponding conditions in ASTM D 1238, namely, at 190° C. and with a load of 2.16 kg.

<Lower Melting-Point Thermoplastic Resin (B)>

The lower melting-point thermoplastic resin (B) contained in the eccentric hollow conjugated continuous fiber according to the present invention is a resin chosen from the above-listed thermoplastic resins and has a melting point or softening point lower than that of the higher melting-point thermoplastic resin (A) by at least 5° C., preferably, 10° C. or more.

The lower melting-point thermoplastic resin (B) used in the present invention is not necessarily a crystalline thermoplastic resin as long as it is a thermoplastic resin having a melting point or softening point of at least 5° C. lower than that of the above-described higher melting-point thermoplastic resin (A).

Depending on the combination of the higher melting-point thermoplastic resin (A) and the lower melting-point thermoplastic resin (B), preferable resins for the lower melting-point thermoplastic resin (B) are propylene/a-olefin random copolymers, namely, random copolymers of propylene and an α-olefin (e.g., ethylene, 1-butene, 1-hexene, and 1-octene), with a melting point of not more than 153° C., preferably, in the range of 125 to 150° C.

Examples of such propylene random copolymers include a propylene random copolymer (Prime Polypro with the product name of J229E (manufactured by Prime Polymer Co., Ltd.; melting point (Tmo): 135° C.) and so forth.

When any one of the above-described random copolymers is used, no particular limitations are imposed as long as its melting point falls within the above-specified range; however, usually, the content ratio of propylene is in the range of 99 to 90 weight % whereas that of the α-olefin involved is in the range of 1 to 10 weight % relative to 100 weight % of the propylene/α-olefin random copolymer.

When a propylene polymer or an ethylene polymer is used in the present invention as the lower melting-point thermoplastic resin (B), the melt-flow rate (MFR) of the resin (B) is not particularly limited as long as it allows the resin (B) to be spun into fiber; however, it is usually in the range of 15 to 100 g/10 minutes, preferably, 50 to 80 g/10 minutes.

In addition, for the resin (B) being a propylene polymer, the above-described MFR is measured under its corresponding conditions in ASTM D 1238, namely, at 230° C. and with a load of 2.16 kg; for the resin (B) being a ethylene polymer(s), the above-described MFR is measured under its corresponding conditions in ASTM D 1238, namely, at 190° C. and with a load of 2.16 kg.

The melting point/softening point of the lower melting-point thermoplastic resin (B) used in the present invention is measured with a differential scanning calorimeter (DSC) in the following way.

First, a sample prepared by filling an aluminum pan for DSC with the lower melting-point thermoplastic resin (B) is gently placed on the position indicated on a DSC.

Then, the sample is heated until the temperature is approximately 50° C. higher than the level at which a peak value is reached on the melting endotherm curve for the heating rate of 10° C./minute, is maintained at the temperature for 10 minutes, and is then cooled to 30° C. at a cooling rate of 10° C./minute. Then, the sample is heated once again to a certain temperature at a heating rate of 10° C./minute, and the melting curve is plotted.

In accordance with the method specified in ASTM D3418-99, the temperature (Tp) at which a peak value is reached on the melting endotherm curve is determined on the melting curve obtained. The endothermic peak at the peak temperature is used as the melting point (Tmo). If no peak value is given at any temperature, the inflection point of the melting endotherm curve is defined as the softening point.

<Eccentric Hollow Conjugated Continuous Fiber>

The eccentric hollow conjugated continuous fiber according to the present invention is an eccentric hollow conjugated synthetic fiber that comprises a part (A), a part containing the above-described higher melting-point thermoplastic resin (A), and a part (B), a part containing the above-described lower melting-point thermoplastic resin (B), the parts (A) and (B) having been bonded to each other in a side by side arrangement.

Note that the "part (A), a part containing the higher melting-point thermoplastic resin (A)" mentioned in the present invention means that the main component of the part (A) is the higher melting-point thermoplastic resin (A); the content ratio of the resin (A) in the part (A) is usually in the range of 55 to 100 weight %.

Similarly, the "part (B), a part containing the lower melting-point thermoplastic resin (B)" mentioned in the present invention means that the main component of the part (B) is the lower melting-point thermoplastic resin (B); the content ratio of the resin (B) in the part (B) is usually in the range of 55 to 100 weight%.

Also, the eccentric hollow conjugated continuous fiber according to the present invention is crimped conjugated continuous fiber; from the viewpoints of bulkiness, flexibility, and others, the ratio of the part (A), a part containing the above-described higher melting-point thermoplastic resin (A), to the part (B), a part containing the above-described lower melting-point thermoplastic resin (B), namely, the part (A):the part (B), is usually 5 to 30 weight %:95 to 70 weight %, preferably, 10 to 25 weight %:90 to 75 weight %.

Additionally, the eccentric hollow conjugated continuous fiber according to the present invention has a hollow eccentric toward the higher melting-point thermoplastic resin (A). In other words, the thickness (a) of the part (A), a part containing the higher melting-point thermoplastic resin (A), is smaller than the thickness (b) of the part (B), a part containing the lower melting-point thermoplastic resin (B).

It should be noted that in this eccentric hollow conjugated continuous fiber, the part (A), a part containing the higher melting-point thermoplastic resin (A), may further contain thermoplastic resins other than the higher melting-point thermoplastic resin (A), crystallizing agents, pigments, and other components unless this prevents the achievement of the object of the present invention.

Examples of the thermoplastic resins other than the higher melting-point thermoplastic resin (A) include high-density polyethylene. If the eccentric hollow conjugated synthetic fiber is desired to be more bulkier, it is preferable to use a higher melting-point thermoplastic resin (A) containing high-density polyethylene. The use of the higher melting-point thermoplastic resin (A) containing high-density polyethylene gives crimpier and bulkier eccentric hollow conjugated continuous fiber.

Similarly, the part (B), a part containing the lower melting-point thermoplastic resin (B), may further contain thermoplastic resins other than the lower melting-point thermoplastic resin (B), crystallizing agents, pigments, and other components unless this prevents the achievement of the object of the present invention.

The thickness (a) of the part (A) on a cross-section of the eccentric hollow conjugated continuous fiber is not particularly limited as long as it is smaller than the thickness (b) of the part (B); however, the ratio of the above-described thickness of the part (A) to that of the part (B) [(a)/(b)] (hereinafter, sometimes simply referred to as "the eccentric hollow conjugated continuous fiber's thickness ratio") is preferably in the range of 0.1 to 0.9, more preferably, 0.2 to 0.6.

Note that in the present invention, when the part (A) is seen on a cross-section of the eccentric hollow conjugated continuous fiber, the thickness (a) of the part (A) is defined as the longest distance from the circumference of the hollow to the facing circumference of the cross-section of the fiber, as shown in FIG. 1-1 to FIG. 1-5.

Similarly, when the part (B) is seen on a cross-section of the eccentric hollow conjugated continuous fiber, the thickness (b) of the part (B) is defined as the longest distance from the circumference of the hollow to the facing circumference of the cross-section of the fiber, as shown in FIG. 1-1 to FIG. 1-5.

The thickness (fineness) of the above-described eccentric hollow conjugated continuous fiber is preferably in the range of 0.8 to 2.5 deniers, more preferably, 0.8 to 1.5 deniers.

The eccentric hollow conjugated continuous fiber according to the present invention contains the part (A) at a content ratio in the above-specified range, has a hollow eccentric toward the part (A), and has a smaller thickness in the part (A) than in the part (B); thus, it can be a conjugated continuous fiber with enhanced crimpiness.

Depending on the combination of the higher melting-point thermoplastic resin (A) and the lower melting-point thermoplastic resin (B) as well as on conditions under which nonwoven fabric is made therefrom, the eccentric hollow conjugated continuous fiber according to the present invention usually has 20 or more crimps per 25 mm, preferably, 20 to 50 crimps per 25 mm.

Furthermore, on a fiber section (a cross-section obtained by cutting the fiber perpendicular to the longitudinal axis is simply referred to as the "fiber section"; this applies throughout the whole present description), it is preferable from the viewpoint of bulkiness that the ratio of the total length of the outer circumference of the part (A) to the total length of the outer circumference of the fiber section is lower than 50%; more preferably, it is lower than 40%, and even more preferably, it is lower than 30%.

The boundaries between the part (A) and part (B) on a fiber section of the eccentric hollow conjugated continuous fiber according to the present invention may be lines or arcs as shown in FIG. 1-1 to FIG. 1-5. When the boundaries on a fiber section are arcs, these boundaries may form an approximately circular shape, in which the part (B) intrudes in the part (A), or a crescent shape, in which the part (B) is concave.

Additionally, the cross-sectional shape of the eccentric hollow conjugated continuous fiber according to the present invention is not necessarily limited to a circle as long as the eccentric hollow conjugated continuous fiber has the above-described characteristics; for example, it may be an ellipsoid or a polygon. From the viewpoint of spinnability, the circle is preferable to the polygon or ellipsoid because the circle prevents the fiber from swinging during spinning; a near perfectly circular eccentric hollow conjugated continuous fiber is particularly preferable.

Conjugated continuous fiber whose hollow is concentric and conjugated continuous fiber whose hollow is eccentric toward the part (B), namely, conjugated continuous fiber in which the thickness of the part (A) is greater than that of the part (B), tend to be inferior in crimpiness even if the part (A) thereof has characteristics falling within the above-specified ranges.

The eccentric hollow conjugated continuous fiber according to the present invention is also characterized in that it has a greater filament strength than eccentric conjugated continuous fiber having no hollow.

The percentage of hollowness of the eccentric hollow conjugated continuous fiber according to the present invention is usually in the range of 5 to 50%, preferably, 10 to 30%. Note that the percentage of hollowness of eccentric hollow conjugated continuous fiber represents the ratio of the cross-sectional area of the hollow to that of the fiber section with the cross-sectional area of the fiber section of the eccentric hollow conjugated continuous fiber defined as 100%.

Depending on the combination of the higher melting-point thermoplastic resin (A) and the lower melting-point thermoplastic resin (B) as well as on conditions under which nonwoven fabric is made therefrom, the eccentric hollow conjugated continuous fiber according to the present invention usually has a single fiber strength of at least 1 gf/d, preferably, 2 gf/d or greater.

<Continuous-Fiber Nonwoven Fabric>

The continuous-fiber nonwoven fabric according to the present invention is a continuous-fiber nonwoven fabric comprising the above-described eccentric hollow conjugated continuous fiber; the basis weight thereof is preferably in the range of 3 to 200 g/m$^2$, preferably, 10 to 150 g/m$^2$.

Additionally, the continuous-fiber nonwoven fabric according to the present invention is preferably nonwoven fabric produced by spunbonding.

Eccentric hollow conjugated continuous fiber obtained by spunbonding is continuous fiber, and thus continuous-fiber nonwoven fabric produced therefrom is almost free from falling out of filaments of eccentric hollow conjugated continuous fiber during use, has enhanced bulkiness and flexibility, and is excellent in terms of mechanical strength.

Depending on the combination of the higher melting-point thermoplastic resin (A) and the lower melting-point thermoplastic resin (B) as well as on the manufacturing conditions thereof, the continuous-fiber nonwoven fabric according to the present invention usually has a bulkiness (specifically, a quotient obtained by dividing the thickness (mm) of the continuous-fiber nonwoven fabric by the basis weight (g/m$^2$) of the continuous-fiber nonwoven fabric) of at least 0.01 mm/(g/m$^2$).

Confounding of sheets of the continuous-fiber nonwoven fabric according to the present invention can be performed using various existing confounding methods, depending the applications of the continuous-fiber nonwoven fabric.

For example, confounding of the sheets may be performed by methods based on needle punching, water jet treatment, ultrasonication, or the like, or by methods in which hot embossing is performed using an embossing roller or hot air is used to fuse some filaments of the fiber constituting the continuous-fiber nonwoven fabric thermally.

This confounding process may be carried out using any one or combination of two or more of the above-listed methods.

When thermal fusion bonding based on heat embossing is employed, treatment is usually carried out so that the percentage of embossed area is in the range of 5 to 40%, preferably in the range of 5 to 25%, and the unit area of unembossed regions is at least 0.5 mm$^2$, preferably in the range of 4 to 40 mm$^2$.

Here, the unembossed regions represent regions each surrounded on all four sides by embossed regions, and the unit area of unembossed regions is defined as the area of the largest inscribed square in the smallest unembossed region.

Embossing treatment that achieves the above-described conditions gives strong nonwoven fabric with the bulkiness of crimped fiber maintained.

<Mixed-Continuous-Fiber Nonwoven Fabric>

The continuous-fiber nonwoven fabric according to the present invention may further contain other kinds of fiber, such as non-crimped continuous fiber, unless this prevents the achievement of the object of the present invention.

For example, when continuous fiber comprising any one of the above-listed thermoplastic resins, such as a propylene polymer, is blended as non-crimped continuous fiber, the shape stability is further improved.

For specific applications, continuous-fiber nonwoven fabric containing the eccentric hollow conjugated continuous fiber according to the present invention may be used in the form of separate sheets or, as detailed in the <Continuous-fiber nonwoven fabric laminate> section, laminates of two or more sheets or those further containing other kinds of layers.

In addition, the continuous-fiber nonwoven fabric according to the present invention can be used as a printing medium.

<Continuous-Fiber Nonwoven Fabric Laminate>

The continuous-fiber nonwoven fabric laminate according to the present invention is obtained by laminating various kinds of layers so that the resultant laminate can be used for specific applications.

Specific examples of the layers contained in the continuous-fiber nonwoven fabric laminate according to the present invention include knitted fabrics, woven fabrics, nonwoven fabrics, films, and so forth.

The continuous-fiber nonwoven fabric laminate according to the present invention may be produced by laminating layers in the following exemplary ways.

Two or more sheets of the continuous-fiber nonwoven fabric according to the present invention are laminated so that the laminated layers are all continuous-fiber nonwoven fabric according to the present invention, to make a continuous-fiber nonwoven fabric laminate.

Two or more sheets of the mixed-continuous-fiber nonwoven fabric according to the present invention are laminated so that the laminated layers are all continuous-fiber nonwoven fabric according to the present invention, to make a continuous-fiber nonwoven fabric laminate.

A sheet of the continuous-fiber nonwoven fabric according to the present invention and one or more sheets of the mixed-continuous-fiber nonwoven fabric according to the present invention are laminated to make a continuous-fiber nonwoven fabric laminate.

A sheet of the mixed-continuous-fiber nonwoven fabric according to the present invention and one or more sheets of the continuous-fiber nonwoven fabric according to the present invention are laminated to make a continuous-fiber nonwoven fabric laminate.

One or more sheets of the mixed-continuous-fiber nonwoven fabric according to the present invention and one or more sheets of the continuous-fiber nonwoven fabric according to the present invention are laminated to make a continuous-fiber nonwoven fabric laminate.

In making a continuous-fiber nonwoven fabric laminate under the individual configurations described above, one or more other existing layers may be added.

When sheets of the continuous-fiber nonwoven fabric according to the present invention are laminated with (bonded to) other layers, examples of applicable methods include thermal fusion bonding such as heat embossing and ultrasonic fusion bonding, mechanical confounding methods such as needle punching and water jet treatment, methods using adhesives such as hot melt adhesives or urethane-based adhesives, extrusion lamination, and other various existing methods.

Examples of nonwoven fabrics that can be laminated with the continuous-fiber nonwoven fabric according to the present invention include spunbonded nonwoven fabrics, melt-blown nonwoven fabrics, wet-laid nonwoven fabrics, dry-laid nonwoven fabrics, dry-laid pulp nonwoven fabrics, flash-spun nonwoven fabrics, open-mesh nonwoven fabrics, and other various existing nonwoven fabrics.

Materials of these nonwoven fabrics include various existing thermoplastic resins.

Specific examples include the following:

polyolefins, such as high-pressure low-density polyethylenes, linear low-density polyethylenes (so-called LLDPE), high-density polyethylenes, polypropylene, polypropylene random copolymers, poly(1-butene), poly(4-methyl-1-pentene), ethylene/propylene random copolymers, ethylene/1-butene random copolymers, and propylene/1-butene random copolymers, which are produced as homopolymers or copolymers of ethylene, propylene, 1-butene, 1-hexene, 4-methyl-1-pentene, 1-octene, and/or other kinds of α-olefins;

polyesters, such as polyethylene terephthalate, polybutylene terephthalate, and polyethylene naphthalate;

polyamides, such as nylon 6, nylon 66, and polymethaxylene adipamide;

polyvinyl chloride; polyimides; ethylene/vinyl acetate copolymers; polyacrylonitrile; polycarbonates; polystyrene; ionomers; thermoplastic polyurethanes; mixtures of them; and so forth.

Preferred ones of these resins include high-pressure low-density polyethylenes, linear low-density polyethylenes (so-called LLDPE), high-density polyethylenes, polypropylene, polypropylene random copolymers, polyethylene terephthalate, polyamides, and so forth.

Preferred modes of laminates of the continuous-fiber nonwoven fabric according to the present invention include laminates containing spunbonded nonwoven fabric containing microfiber produced by spunbonding (fineness: 0.8 to 2.5 deniers, preferably, 0.8 to 1.5 deniers) and/or melt-blown nonwoven fabric.

Specific examples include the following:

two-layer laminates comprising spunbonded nonwoven fabric (microfiber)/spunbonded nonwoven fabric (eccentric hollow conjugated continuous fiber) [the continuous-fiber nonwoven fabric according to the present invention], melt-blown nonwoven fabric/spunbonded nonwoven fabric (eccentric hollow conjugated continuous fiber), or the like;

three-layer laminates comprising spunbonded nonwoven fabric (microfiber)/spunbonded nonwoven fabric (eccentric hollow conjugated continuous fiber)/spunbonded nonwoven fabric (microfiber), spunbonded nonwoven fabric (microfiber)/spunbonded nonwoven fabric (eccentric hollow conjugated continuous fiber)/melt-blown nonwoven fabric, spunbonded nonwoven fabric (microfiber)/melt-blown nonwoven fabric/spunbonded nonwoven fabric (eccentric hollow conjugated continuous fiber), or the like; and laminates of four or more layers comprising spunbonded nonwoven fabric (microfiber)/spunbonded nonwoven fabric (eccentric hollow conjugated continuous fiber)/melt-blown nonwoven fabric/spunbonded nonwoven fabric (microfiber), spunbonded nonwoven fabric (microfiber)/spunbonded nonwoven fabric (eccentric hollow conjugated continuous fiber)/melt-blown nonwoven fabric/spunbonded nonwoven fabric (crimped conjugated continuous fiber)/spunbonded nonwoven fabric (microfiber), or the like.

The basis weight of the nonwoven fabric layers laminated is preferably in the range of 2 to 25 g/m$^2$ for all the layers.

The above-described spunbonded nonwoven fabric comprising microfiber can be obtained by controlling (choosing) the manufacturing conditions for spunbonding.

Such continuous-fiber nonwoven fabric laminates take advantage of the bulkiness and flexibility of the continuous-fiber nonwoven fabric according to the present invention, which contains the above-described eccentric hollow conjugated continuous fiber, are excellent in surface smoothness, and have water resistance improved.

Films laminated with sheets of the continuous-fiber nonwoven fabric according to the present invention, which contains the above-described eccentric hollow conjugated continuous fiber, are preferably air-permeable (moisture-permeable) films, which take advantage of the distinctive air permeability of the continuous-fiber nonwoven fabric according to the present invention.

Various existing air-permeable films can be used as the above-described air-permeable films.

Examples thereof include films containing moisture-permeable thermoplastic elastomers, such as polyurethane elastomers, polyester elastomers, and polyamide elastomers; porous films obtained by drawing films containing thermoplastic resins containing inorganic or organic fine particles to make them porous; and so forth.

Preferred examples of thermoplastic resins for such porous films include polyolefins such as high-pressure low-density polyethylenes, linear low-density polyethylenes (so-called LLDPE), high-density polyethylenes, polypropylene, and polypropylene random copolymers and compositions made from them.

Laminates containing such air-permeable films can be cloth-like composite materials that take advantage of the bulkiness and flexibility of the continuous-fiber nonwoven fabric according to the present invention, which contains the above-described eccentric hollow conjugated continuous fiber, and that have very high water resistance.

<Method for Manufacturing the Eccentric Hollow Conjugated Continuous Fiber and That for Making the Continuous-Fiber Nonwoven Fabric from the Eccentric Hollow Conjugated Continuous Fiber>

The eccentric hollow conjugated continuous fiber and the continuous-fiber nonwoven fabric containing it according to the present invention, which are both described above, can be made using various existing manufacturing methods.

In particular, spunbonding-based manufacturing methods give highly crimped eccentric hollow conjugated continuous fiber and continuous-fiber nonwoven fabric containing it with no need for heat treatment or post-spinning drawing using rollers or the like, and the methods thus are preferable.

Specific exemplary procedures for making the eccentric hollow conjugated continuous fiber and continuous-fiber nonwoven fabric containing it according to the present invention are as follows.

First, the higher melting-point thermoplastic resin (A), which forms one part of the eccentric hollow conjugated continuous fiber, and the lower melting-point thermoplastic resin (B), which forms another part of the eccentric hollow conjugated continuous fiber, are melted in separate extruders.

Then, the melted resins are discharged from a spinneret to be shaped into the eccentric hollow conjugated continuous fiber.

More specifically, the melted resins are discharged from a spinneret that has a composite spinning nozzle configured so that the eccentric hollow conjugated continuous fiber discharged therefrom can have the following structure: the component A and the component B are contained at a ratio (weight ratio) in the range of 5/95 to 30/70; the component A and the component B are in contact with each other on all cross-sections; the hollow is eccentric toward the part (A); and the thickness of the part (A) is smaller than that of the part (B).

Examples of applicable spinnerets include a spinneret that has a composite spinning nozzle in which the opening (slit width) of the slit for discharging the higher melting-point thermoplastic resin (A) is narrower than that of the slit for discharging the lower melting-point thermoplastic resin (B).

Then, the eccentric hollow conjugated continuous fiber spun is cooled with cooling air (e.g., at a temperature in the range of 15 to 30° C.) and simultaneously drawn with rapid air until a predetermined fineness is reached. Then, the eccentric hollow conjugated continuous fiber is collected by deposition on a collection belt until a predetermined thickness (basis weight) is reached.

If necessary, the continuous-fiber nonwoven fabric according to the present invention can be made in the following way: in the deposit 'obtained as above, confounding of filaments of the eccentric hollow conjugated continuous fiber are performed by any one of methods based on needle punching, water jet treatment, ultrasonication, or the like, by hot embossing using an embossing roller, by any one of methods in which hot air is used to fuse some filaments of the fiber, or by any other confounding method.

In addition, the number of slits may be increased for a higher percentage of hollowness, or the difference in slit width may be increased for higher eccentricity.

<Method for Making the Mixed-Continuous-Fiber Nonwoven Fabric>

The mixed-continuous-fiber nonwoven fabric according to the present invention can be made using the following exemplary method, in which mixed-continuous-fiber nonwoven fabric containing clearly crimped continuous fiber and non-crimped continuous fiber is obtained.

First, thermoplastic resins are melted in an apparatus for making spunbonded nonwoven fabric and then discharged from a composite spinning nozzle equipped with a spinneret for clearly crimped continuous fiber and that for non-crimped continuous fiber so that the thermoplastic resins can be spun into conjugated continuous fiber and continuous fiber. Then, the mixture of the conjugated continuous fiber and continuous fiber spun are drawn with high speed air until a predetermined fineness is reached, while the fiber mixture is being cooled with cooling air, and the conjugated continuous fiber is simultaneously crimped. Then, the fiber mixture is collected by deposition on a collection belt until a predetermined thickness (basis weight) is reached. If necessary, confounding of filaments of the fiber mixture are performed by any one of confounding methods represented by methods based on needle punching, water jet treatment, ultrasonication, or the like, and methods in which hot embossing using an embossing roller is performed or hot air is used to fuse some filaments of the fiber.

Note that if the same kind of thermoplastic resin as the higher melting-point thermoplastic resin (A), a component of the conjugated continuous fiber, is used as thermoplastic resin for the non-crimped continuous fiber, the relevant extruder may have a branched tip so that the resin melted therein can be fed to the spinneret for clearly crimped continuous fiber and that for non-crimped continuous fiber.

<Applications>

The eccentric hollow conjugated continuous fiber, continuous-fiber nonwoven fabric, and mixed-continuous-fiber nonwoven fabric according to the present invention and continuous-fiber nonwoven fabric laminates containing the above-described continuous-fiber nonwoven fabric and/or mixed-continuous-fiber nonwoven fabric according to the present invention can be used in various applications.

For example, the above-described products can be widely used as surgical gowns, wrapping cloths, bed sheets, pillow cases, and other kinds of bedclothes, carpets, ground fabric for artificial leathers, and other supplies in fields of medicine, industrial materials, civil engineering and construction, agricultural and gardening materials, household goods, and so forth.

In particular, the continuous-fiber nonwoven fabric, mixed-continuous-fiber nonwoven fabric, and continuous-fiber nonwoven fabric laminates containing the above-described continuous-fiber nonwoven fabric and/or mixed-continuous-fiber nonwoven fabric according to the present invention are not only bulky but also excellent in terms of lint-free performance and shape stability, flexible, and offers good touch and drape and thus are particularly suitable to use as materials of paper diapers, sheets for barrier leg cuff, and sanitary napkins.

<Sheet for barrier leg cuff>The sheet for barrier leg cuff according to the present invention contains the above-described continuous-fiber nonwoven fabric or mixed-continuous-fiber nonwoven fabric according to the present invention or a continuous-fiber nonwoven fabric laminate containing the above-described continuous-fiber nonwoven fabric and/or mixed-continuous-fiber nonwoven fabric according to the present invention and can be used for a component of three-dimensional gathers of paper diapers, sanitary napkins, and other similar products.

Three-dimensional gathers are required to be excellent in terms of air permeability, prevention of leakage of loose feces, and feel against skin, and thus the continuous-fiber nonwoven fabric or mixed-continuous-fiber nonwoven fabric according to the present invention or continuous-fiber nonwoven fabric laminates containing the above-described continuous-fiber nonwoven fabric and/or mixed-continuous-fiber nonwoven fabric according to the present invention are suitably used to make them.

<Paper Diaper>

The paper diaper according to the present invention contains the above-described continuous-fiber nonwoven fabric or mixed-continuous-fiber nonwoven fabric according to the present invention or a continuous-fiber nonwoven fabric laminate containing the above-described continuous-fiber nonwoven fabric and/or mixed-continuous-fiber nonwoven fabric according to the present invention, which can be used not only as a component of the above-described sheets for barrier leg cuff (side gathers) but also as a component of the surfacing sheet, back sheet, top sheet, waist piece, and other pieces for paper diapers.

<Sanitary Napkin>

The sanitary napkin according to the present invention contains the above-described continuous-fiber nonwoven fabric according to the present invention or a continuous-fiber nonwoven fabric laminate containing the above-described continuous-fiber nonwoven fabric according to the present invention, which can be used not only as a component of the above-described sheets for barrier leg cuff (side gathers) but also as a component of the surfacing sheet, side gathers, back sheet, top sheet, and other pieces for sanitary napkins.

EXAMPLES

Hereinafter, the present invention is described in more detail with reference to examples thereof; however, the present invention is never limited to these examples.

Note that the characteristics of the eccentric hollow conjugated continuous fiber and continuous-fiber nonwoven fabric obtained in Examples and Comparative Examples were determined as follows.

(1) Filament Strength (gf/d)

The filament strength was measured in accordance with JIS L1905 (Method 7.5.1).

First, 60 filaments were sampled under the conditions specified in JIS Z8703 (Standard atmospheric conditions for testing), or in an air-conditioned room with the temperature set at 20±2° C. and the humidity set at 65±2%. Then, tensile test was performed using a tensile testing machine (Instron 5564 manufactured by Instron Japan Co., Ltd.) with the chuck distance set at 20 mm and the stress rate set at 20 mm/minute for measuring the tensile load of each of the 60 specimens. The average of the maximum tolerated tensile loads was defined as the filament strength.

(2) Number of Crimps (per 25 mm)

Prior to the test, slips of glossy paper with smooth surface were each given lines with a spatial distance of 25 mm.

Then, from continuous-fiber nonwoven fabric that had not been heated or had not been pressurized using an embossing roll as the source, filaments of the eccentric hollow conjugated continuous fiber were sampled carefully so that the crimpiness would be maintained. Then, the sampled filaments of the eccentric hollow conjugated continuous fiber were individually bonded at both ends to the above-described slips of paper using an adhesive with the laxity measuring 25±5% of the spatial distance. Then, the number of crimps was determined for the specimens obtained, individual filaments of the eccentric hollow conjugated continuous fiber, in the following way. One of the filaments of the eccentric hollow conjugated continuous fiber was held with the chucks of a crimp tester, the slip of paper was cut, and then the initial load (0.18 mN× the line density indicated in tex) was applied to the specimen. Then, the distance between the chucks (spatial distance) (mm) was recorded, the crimps were counted, and the number of crimps per 25 mm length was calculated. Note that the number of crimps counted was the value obtained by counting all peaks and bottoms and then dividing the total number by two.

The number of crimps was determined for twenty filaments of the eccentric hollow conjugated continuous fiber in the way described above, and then the average number of crimps determined was rounded off to one decimal place; the value obtained was defined as the number of crimps of the eccentric hollow conjugated continuous fiber. Note that this test for the number of crimps was carried out under the conditions specified in JIS Z8703 (Standard atmospheric conditions for testing), or in an air-conditioned room with the temperature set at 20±2° C. and the humidity set at 65±2%.

(3) Percentage of Hollowness (%)

A specimen was obtained by embedding a sheet of the continuous-fiber nonwoven fabric in a piece of epoxy resin and then cutting the piece of epoxy resin with a microtome. Then, the cross-section of the specimen was imaged with an electron microscope [a scanning electron microscope S-3500N manufactured by Hitachi, Ltd.], the cross-sectional area was determined for each entire filament and its hollow on the microscopic cross-sectional image obtained, and then the percentage of hollowness (%) was calculated using the following formula.

Percentage of hollowness [%]=(Cross-sectional area of the hollow/Cross-sectional area of the entire filament)×100

The percentage of hollowness was determined for twenty filaments of the eccentric hollow conjugated continuous fiber in the way described above, and then the average percentage of hollowness was defined as the percentage of hollowness of the eccentric hollow conjugated continuous fiber.

(4) The eccentric hollow conjugated continuous fiber's thickness ratio

A specimen was obtained by embedding a sheet of the continuous-fiber nonwoven fabric in a piece of epoxy resin and then cutting the piece of epoxy resin with a microtome. Then, the cross-section of the specimen was imaged with an electron microscope[a scanning electron microscope S-3500N manufactured by Hitachi, Ltd.], the thickness (a) of the part (A) and the thickness (b) of the part (B) on the fiber section were determined for each entire filament of the eccentric hollow conjugated continuous fiber on the microscopic cross-sectional image obtained, and then the [a/b] was calculated.

The thickness ratio was determined for twenty filaments of the eccentric hollow conjugated continuous fiber in the way described above, and then the average thickness ratio was defined as the eccentric hollow conjugated continuous fiber's thickness ratio [a/b].

(5) Bulkiness [mm/(g/m$^2$)]

The bulkiness was measured in accordance with JIS L1906 (6.5).

First, with a sheet of the continuous-fiber nonwoven fabric as the source, a specimen measuring 10 cm in the machine direction (MD) and 10 cm in the cross direction (CD) was sampled under the conditions specified in JIS Z8703 (Standard atmospheric conditions for testing), or in an air-conditioned room with the temperature set at 20±2° C. and the humidity set at 65±2%. Then, the specimen obtained was weighed, and the basis weight (g/m$^2$) thereof was calculated. Then, the thickness (mm) of the specimen was measured in a thickness gauge (Tester Sangyo Co., Ltd.) by pressing the stylet having a diameter of 1.6 cm against five points on the specimen with a predetermined pressure (20 g) for a predetermined period of time (10 seconds). Then, the bulkiness of the continuous-fiber nonwoven fabric was calculated by dividing the thickness (mm) of the specimen by the basis weight (g/m$^2$) of the specimen.

Note that the greater the ratio of the thickness to the basis weight is, the better the bulkiness of the continuous-fiber nonwoven fabric is.

(6) Stiffness (45° Cantilever Method)

The stiffness was measured in accordance with JIS L1096 (6.19.1, Method A).

First, with a sheet of the continuous-fiber nonwoven fabric as the source, five specimens each having a length of 150 mm along the machine direction (MD) and a width of 20 mm and another five specimens each having a length of 150 mm along the cross direction (CD) and a width of 20 mm were sampled under the conditions specified in JIS Z8703 (Standard atmospheric conditions for testing), or in an air-conditioned room with the temperature set at 20±2° C. and the humidity set at 65±2%. Each of the specimens was placed on a horizontal table having a smooth surface and a 45° slope with one of the narrow sides thereof aligned with the baseline of the scale. Then, the specimen was manually and slowly slid toward the slope. At the time the midpoint of one end of the specimen reached the slope, the travel distance of the other end was read on the scale. The travel distance of the specimen indicated in mm was defined as the degree of stiffness. The degree of stiffness was measured for five specimens per fiber direction while the measurement was being repeated with the specimens turned over. Then, the average degree of stiffness was determined for the machine direction (MD) and the cross direction (CD).

Note that when the degree of stiffness is equal to or smaller than 50 mm for both the machine direction (MD) and the cross direction (CD), the flexibility is favorable.

(7) Lint-Free Performance (FUZZ)

With a sheet of the continuous-fiber nonwoven fabric as the source, three specimens each measuring 11 cm in the machine direction (MD) and 4 cm in the cross direction (CD) were sampled for the measurement of the strength in the MD direction, and three specimens each measuring 11 cm in the cross direction (CD) and 4 cm in the machine direction (MD) were sampled for the measurement of the strength in the CD direction. This sampling procedure was carried out under the conditions specified in JIS Z8703 (Standard atmospheric conditions for testing), or in an air-conditioned room with the temperature set at 20±2° C. and the humidity set at 65±2%.

Then, a piece of double-coated tape (ST-416P manufactured by Sumitomo 3M Ltd.) was attached to one face of each of the specimens sampled, the face not for measurement, and then the protection film covering the face of the piece of double-coated tape not adhering to the specimen was peeled off. Then, the specimen was attached to a plate for measurement. A weight (dimensions: 5×15×3.8 cm; weight: 2200 g) was placed on the specimen and allowed to stand for 20 seconds so that the specimen could be fixed on the plate for measurement. After the 20-second period passed, the weight was removed, and a piece of sandpaper (Mctalite K-224-505) was attached to the grinder located above the plate for measurement. The grinder was brought into contact with the specimen and then reciprocated 20 times in the longitudinal direction of the specimen at a constant rate (42 cycles/minute) with the grinder pressed against the specimen with a constant load (load: 0.91 kg).

After the twenty cycles of reciprocation, the grinder was removed. A piece of single-coated tape ("Scotch" surface protection tape manufactured by Sumitomo 3M Ltd.), which had been cut into a square measuring 4 cm×11 cm and weighed (the baseline weight), was attached to the specimen, and then a weight (dimensions: 5×15×3.8 cm; weight: 2200 g) was placed on the specimen and allowed to stand for 20 seconds so that the piece of single-coated tape could be fixed on the specimen.

After the 20-second period passed, the weight was removed, and the piece of single-coated tape was peeled off the specimen. The piece of single-coated tape was weighed together with the filaments caught thereon (the final weight), and then the quantity of detached filaments was calculated using the following formula.

$$\text{Quantity of detached filaments (mg/cm}^2\text{)} = (\text{Final weight} - \text{Baseline weight}) \times 1000 \div 44$$

The above-described quantity of detached filaments was determined for both faces of the specimen.

Note that the smaller the quantity of detached filaments is, the better the lint-free performance (FUZZ) of the continuous-fiber nonwoven fabric is.

(8) Shape Stability

With a sheet of the continuous-fiber nonwoven fabric as the source, three specimens each measuring 26 cm in the machine direction (MD) and 13 cm in the cross direction (CD) were sampled under the conditions specified in JIS Z8703 (Standard atmospheric conditions for testing), or in an air-conditioned room with the temperature set at 20±2° C. and the humidity set at 65±2%. Then, tensile test was performed in the specimens using a tensile testing machine (Instron 5564 manufactured by Instron Japan Co., Ltd.) with the chuck distance set at 210 mm, the stress rate set at 50 mm/minute, and the maximum load set at 4 kgf. The length A (mm) in the CD direction was measured in the middle of the length in the MD direction, (A/130)×100 (%) was calculated, and then the average of the calculations for the three specimens was defined as the degree of shape stability.

Note that the greater the degree of shape stability is, the better the continuous-fiber nonwoven fabric is in terms of resistance to necking during processing.

Example 1

Higher melting-point thermoplastic resin (A): A propylene homopolymer (MFR measured at 230° C. under a load of 2160 g: 60 g/10 minutes; melting point (Tmo): 157° C.)

Lower melting-point thermoplastic resin (B): A propylene/ethylene random copolymer (MFR measured at 230° C. under a load of 2160 g: 60 g/10 minutes; Mw/Mn=2.4; melting point (Tmo): 143° C.; ethylene content: 4 mol %)

The above-described higher melting-point thermoplastic resin (A) and lower melting-point thermoplastic resin (B) were melted in separate extruders (each having a diameter of 30 mm) with the molding temperature set at 200° C. Then, continuous-fiber nonwoven fabric was manufactured in the apparatus for making nonwoven fabric shown in FIG. 6 (a spunbonding machine; length perpendicular to the machine direction on the collection surface: 100 mm). This apparatus had a spinneret whose nozzle pitch was 9.1 mm in the machine direction and 8.3 mm in the cross direction and whose slit arrangement was as shown in FIG. 7, and the spinneret was positioned so that the fiber section shown in FIG. 1-1 could be obtained. More specifically, the manufacturing procedure was as follows. The higher melting-point thermoplastic resin (A) and lower melting-point thermoplastic resin (B) were spun into eccentric hollow conjugated continuous fiber that had the cross-sectional shape shown in FIG. 1-1, with the weight ratio of the resin (A) to the resin (B) set at 20/80. The eccentric hollow conjugated continuous fiber spun was drawn at a yarn speed of 2500 m/minute under cooling with air (25° C.), allowed to accumulate on the collection belt. Then, the deposit obtained was heated and pressurized with an embossing roller (percentage of embossed area: 20.6%; temperature of embossing: 125° C.), yielding continuous-fiber nonwoven fabric with a basis weight of 25 g/m$^2$. For the eccentric hollow conjugated continuous fiber contained in the resultant continuous-fiber nonwoven fabric, the ratio of the outer circumference of the part (A) to the total outer circumference of the fiber section was 35%.

Note that in FIG. 6, the numeral 1 represents the first extruder, and the numeral 1' the second extruder; the first extruder and the second extruder contain different kinds of resins. In FIG. 1, the numeral 2 represents a spinneret, the numeral 3 continuous filaments, the numeral 4 cooling air, the numeral 5 an ejector, the numeral 6 a collector, the numeral 7 an aspirator, the numeral 8 a web, and the numeral 10 a take-up roller.

The characteristics of the continuous-fiber nonwoven fabric were measured in the ways described earlier. The measurements are shown in Table 1.

Example 2

Higher melting-point thermoplastic resin (A): A propylene homopolymer (MFR measured at 230° C. under a load of 2160 g: 60 g/10 minutes; melting point (Tmo): 157° C.)

Lower melting-point thermoplastic resin (B): A propylene/ethylene random copolymer (MFR measured at 230° C. under a load of 2160 g: 60 g/10 minutes; Mw/Mn=2.4; melting point (Tmo): 143° C.; ethylene content: 4 mol %)

The above-described higher melting-point thermoplastic resin (A) and lower melting-point thermoplastic resin (B) were melted in separate extruders (each having a diameter of 30 mm) with the molding temperature set at 200° C. Then, continuous-fiber nonwoven fabric was manufactured in the apparatus for making nonwoven fabric shown in FIG. 6 (a spunbonding machine; length perpendicular to the machine direction on the collection surface: 100 mm). This apparatus had a spinneret whose nozzle pitch was 9.1 mm in the machine direction and 8.3 mm in the cross direction and whose slit arrangement was as shown in FIG. 7, and the spinneret was positioned so that the fiber section shown in FIG. 1-1 could be obtained. More specifically, the manufacturing procedure was as follows. The higher melting-point thermoplastic resin (A) and lower melting-point thermoplastic resin (B) were spun into the eccentric hollow conjugated continuous fiber shown in FIG. 1-1, with the weight ratio of the resin (A) to the resin (B) set at 20/80. The eccentric hollow conjugated continuous fiber spun was drawn at a yarn speed of 3000 m/minute under cooling with air (25° C.), allowed to accumulate on the collection belt. Then, the deposit obtained was heated and pressurized with an embossing roller (percentage of embossed area: 20.6%; temperature of embossing: 125° C.), yielding continuous-fiber nonwoven fabric with a basis weight of 25 g/m$^2$. For the eccentric hollow conjugated continuous fiber contained in the resultant continuous-fiber nonwoven fabric, the ratio of the outer circumference of the part (A) to the total outer circumference of the fiber section was 35%.

The characteristics of the continuous-fiber nonwoven fabric were measured in the ways described earlier. The measurements are shown in Table 1.

Comparative Example 1

Higher melting-point thermoplastic resin (A): A propylene homopolymer (MFR measured at 230° C. under a load of 2160 g: 60 g/10 minutes; melting point (Tmo): 157° C.)

Lower melting-point thermoplastic resin (B): A propylene/ethylene random copolymer (MFR measured at 230° C. under a load of 2160 g: 60 g/10 minutes; Mw/Mn=2.4; melting point (Tmo): 143° C.; ethylene content: 4 mol %)

The above-described higher melting-point thermoplastic resin (A) and lower melting-point thermoplastic resin (B) were melted in separate extruders (each having a diameter of 30 mm) with the molding temperature set at 200° C. Then, continuous-fiber nonwoven fabric was manufactured in the apparatus for making nonwoven fabric shown in FIG. 6 (a spunbonding machine; length perpendicular to the machine direction on the collection surface: 100 mm). This apparatus had a spinneret whose nozzle diameter was 0.6 mm and whose nozzle pitch was 9.1 mm in the machine direction and 8.3 mm in the cross direction, and the spinneret was positioned so that the fiber section shown in FIG. 2 could be obtained. More specifically, the manufacturing procedure was as follows. The higher melting-point thermoplastic resin (A) and lower melting-point thermoplastic resin (B) were spun into crimped conjugated continuous fiber through a spinneret for crimped conjugated continuous fiber that gives the cross-sectional shape shown in FIG. 2, with the weight ratio of the resin (A) to the resin (B) set at 20/80. The crimped conjugated continuous fiber spun was drawn at a yarn speed of 2500 m/minute under cooling with air (25° C.), allowed to accumulate on the collection belt. Then, the deposit obtained was heated and pressurized with an embossing roller (percentage of embossed area: 20.6%; temperature of embossing: 120° C.), yielding continuous-fiber nonwoven fabric with a basis weight of 25 g/m$^2$.

For the eccentric conjugated continuous fiber contained in the resultant continuous-fiber nonwoven fabric, the ratio of the outer circumference of the part (A) to the total outer circumference of the fiber section was 35%.

The characteristics of the continuous-fiber nonwoven fabric were measured in the ways described earlier. The measurements are shown in Table 1.

Comparative Example 2

Higher melting-point thermoplastic resin (A): A propylene homopolymer (MFR measured at 230° C. under a load of 2160 g: 60 g/10 minutes; melting point (Tmo): 157° C.)

Lower melting-point thermoplastic resin (B): A propylene/ethylene random copolymer (MFR measured at 230° C. under a load of 2160 g: 60 g/10 minutes; Mw/Mn=2.4; melting point (Tmo): 143° C.; ethylene content: 4 mol %)

The above-described higher melting-point thermoplastic resin (A) and lower melting-point thermoplastic resin (B) were melted in separate extruders (each having a diameter of 30 mm) with the molding temperature set at 200° C. Then, continuous-fiber nonwoven fabric was manufactured in the apparatus for making nonwoven fabric shown in FIG. 6 (a spunbonding machine; length perpendicular to the machine direction on the collection surface: 100 mm). This apparatus had a spinneret whose nozzle pitch was 9.1 mm in the machine direction and 8.3 mm in the cross direction and whose slit arrangement was as shown in FIG. 7, and the spinneret was positioned so that the fiber section shown in FIG. 3 could be obtained. More specifically, the manufacturing procedure was as follows. The higher melting-point thermoplastic resin (A) and lower melting-point thermoplastic resin (B) were spun into crimped conjugated continuous fiber through a spinneret for crimped conjugated continuous fiber that gives the cross-sectional shape shown in FIG. 3, with the weight ratio of the resin (A) to the resin (B) set at 50/50. The crimped conjugated continuous fiber spun was drawn at a yarn speed of 2500 m/minute under cooling with air (25° C.), allowed to accumulate on the collection belt. Then, the deposit obtained was heated and pressurized with an embossing roller (percentage of embossed area: 20.6%; temperature of embossing: 120° C.), yielding continuous-fiber nonwoven fabric with a basis weight of 25 g/m$^2$.

For the eccentric hollow conjugated continuous fiber contained in the resultant continuous-fiber nonwoven fabric, the ratio of the outer circumference of the part (A) to the total outer circumference of the fiber section was 50%.

The characteristics of the continuous-fiber nonwoven fabric were measured in the ways described earlier. The measurements are shown in Table 1.

Comparative Example 3

Higher melting-point thermoplastic resin (A): A propylene homopolymer (MFR measured at 230° C. under a load of 2160 g: 60 g/10 minutes; melting point (Tmo): 157° C.)

Lower melting-point thermoplastic resin (B): A propylene/ethylene random copolymer (MFR measured at 230° C. under a load of 2160 g: 60 g/10 minutes; Mw/Mn=2.4; melting point (Tmo): 143° C.; ethylene content: 4 mol %)

The above-described higher melting-point thermoplastic resin (A) and lower melting-point thermoplastic resin (B)

were melted in separate extruders (each having a diameter of 30 mm) with the molding temperature set at 200° C. Then, continuous-fiber nonwoven fabric was manufactured in the apparatus for making nonwoven fabric shown in FIG. 6 (a spunbonding machine; length perpendicular to the machine direction on the collection surface: 100 mm). This apparatus had a spinneret whose nozzle pitch was 9.1 mm in the machine direction and 8.3 mm in the cross direction and whose slit arrangement was as shown in FIG. 8, and the spinneret was positioned so that the fiber section shown in FIG. 4 could be obtained. More specifically, the manufacturing procedure was as follows. The higher melting-point thermoplastic resin (A) and lower melting-point thermoplastic resin (B) were spun into crimped conjugated continuous fiber with the weight ratio of the resin (A) to the resin (B) set at 20/80. The crimped conjugated continuous fiber spun was drawn at a yarn speed of 2500 m/minute under cooling with air (25° C.), allowed to accumulate on the collection belt. Then, the deposit obtained was heated and pressurized with an embossing roller (percentage of embossed area: 20.6%; temperature of embossing: 120° C.), yielding continuous-fiber nonwoven fabric with a basis weight of 25 g/m$^2$.

For the centric hollow conjugated continuous fiber contained in the resultant continuous-fiber nonwoven fabric, the ratio of the outer circumference of the part (A) to the total outer circumference of the fiber section was 35%.

The characteristics of the continuous-fiber nonwoven fabric were measured in the ways described earlier. The measurements are shown in Table 1.

Comparative Example 4

Higher melting-point thermoplastic resin (A): A propylene homopolymer (MFR measured at 230° C. under a load of 2160 g: 60 g/10 minutes; melting point (Tmo): 157° C.)

Lower melting-point thermoplastic resin (B): A propylene/ethylene random copolymer (MFR measured at 230° C. under a load of 2160 g: 60 g/10 minutes; Mw/Mn=2.4; melting point (Tmo): 143° C.; ethylene content: 4 mol %)

The above-described higher melting-point thermoplastic resin (A) and lower melting-point thermoplastic resin (B) were melted in separate extruders (each having a diameter of 30 mm) with the molding temperature set at 200° C. Then, continuous-fiber nonwoven fabric was manufactured in the apparatus for making nonwoven fabric shown in FIG. 6 (a spunbonding machine; length perpendicular to the machine direction on the collection surface: 100 mm). This apparatus had a spinneret whose nozzle pitch was 9.1 mm in the machine direction and 8.3 mm in the cross direction and whose slit arrangement was as shown in FIG. 7, and the spinneret was positioned so that the fiber section shown in FIG. 5 could be obtained. More specifically, the manufacturing procedure was as follows. The higher melting-point thermoplastic resin (A) and lower melting-point thermoplastic resin (B) were spun into crimped conjugated continuous fiber with the weight ratio of the resin (A) to the resin (B) set at 20/80. The crimped conjugated continuous fiber spun was drawn at a yarn speed of 2500 m/minute under cooling with air (25° C.), allowed to accumulate on the collection belt. Then, the deposit obtained was heated and pressurized with an embossing roller (percentage of embossed area: 20.6%; temperature of embossing: 120° C.), yielding continuous-fiber nonwoven fabric with a basis weight of 25 g/m$^2$.

For the eccentric hollow conjugated continuous fiber contained in the resultant continuous-fiber nonwoven fabric, the ratio of the outer circumference of the part (A) to the total outer circumference of the fiber section was 15%.

The characteristics of the continuous-fiber nonwoven fabric were measured in the ways described earlier. The measurements are shown in Table 1.

TABLE 1

| | | | Example 1 | Example 2 | Comparative Example 1 | Comparative Example 2 | Comparative Example 3 | Comparative Example 4 |
|---|---|---|---|---|---|---|---|---|
| Number of crimps | /25 mm | | 29.5 | 35.6 | 18.6 | 10.3 | 10.6 | 22.7 |
| Filament strength | Gf/d | | 2.50 | 2.54 | 1.26 | 2.65 | 2.49 | 2.12 |
| % Hollowness | % | | 15 | 15 | — | 15 | 15 | 15 |
| Thickness ratio | a/b | | 0.5 | 0.5 | — | — | — | — |
| Thickness | mm/(g/m$^2$) | | 0.014 | 0.015 | 0.010 | 0.009 | 0.010 | 0.013 |
| Cantilever | mm | MD | 84 | 74 | 86 | 88 | 75 | 73 |
| | | CD | 47 | 37 | 48 | 51 | 58 | 49 |
| FUZZ | Embossed face | MD | 0.03 | 0.04 | 0.05 | 0.05 | 0.07 | 0.06 |
| | | CD | 0.04 | 0.04 | 0.04 | 0.06 | 0.07 | 0.06 |
| | Non-embossed face | MD | 0.04 | 0.04 | 0.05 | 0.09 | 0.08 | 0.04 |
| | | CD | 0.04 | 0.04 | 0.06 | 0.09 | 0.08 | 0.03 |
| Quantity of necking | % | | 12% | 10% | 17% | 7% | 10% | 12% |

As clearly seen in Table 1, continuous-fiber nonwoven fabric containing eccentric hollow conjugated continuous fiber in which the thickness ratio was in the range of 0.1 to 0.9, the hollow thereof was eccentric toward the higher melting-point thermoplastic resin (A), and the thickness (a) of the part (A) was smaller than the thickness (b) of the part (B) containing thermoplastic resin (B) (Example 1 and Example 2) was superior in bulkiness and flexibility, offered a low quantity of filaments detached therefrom by friction, and was superior in shape stability with a filament strength of greater than 2.0 gf/d and the number of crimps as many as 29 to 35 crimps/25 mm.

Table 1 also shows that continuous-fiber nonwoven fabric containing solid conjugated continuous fiber (Comparative Example 1) had a filament strength as low as 1.26 gf/d and the number of crimps as few as 19 crimps/25 mm and was inferior in bulkiness and shape stability.

Table 1 further shows that continuous-fiber nonwoven fabric containing crimped conjugated continuous fiber (Comparative Example 2), continuous-fiber nonwoven fabric containing concentric hollow conjugated continuous fiber (Comparative Example 3), and continuous-fiber nonwoven fabric containing eccentric hollow conjugated continuous fiber eccentric toward the lower melting-point thermoplastic resin (B) (Comparative Example 4) were all superior in shape stability but were inferior in the number of crimps and thus inferior in bulkiness.

INDUSTRIAL APPLICABILITY

The continuous-fiber nonwoven fabric containing the eccentric hollow conjugated continuous fiber according to the present invention is not only bulky but also excellent in terms of lint-free performance and shape stability; thus, it can be suitably used in paper diapers, sanitary napkins, and other hygienic materials as well as in wiping cloths. Furthermore, it is flexible and offers good drape and thus can be widely used as surgical gowns, wrapping cloths, bed sheets, pillow cases, and other kinds of bedclothes, carpets, ground fabric for artificial leathers, and other supplies in fields of medicine, industrial materials, civil engineering and construction, agricultural and gardening materials, household goods, and so forth.

The invention claimed is:

1. An eccentric hollow conjugated continuous fiber comprising a part (A), a part containing a higher melting-point thermoplastic resin (A), and a part (B), a part containing a lower melting-point thermoplastic resin (B), the parts (A) and (B) bonded to each other in a side by side arrangement, wherein:

the difference in melting point between the higher melting-point thermoplastic resin (A) and the lower melting-point thermoplastic resin (B) is 5° C. or greater;

the eccentric hollow conjugated continuous fiber has a part (A):part (B) proportion in the range of 5to 30 weight %:95 to 70 weight %;

the eccentric hollow conjugated continuous fiber has a cross-section in which the thickness (a) of the part (A) is smaller than the thickness (b) of the part (B), a ratio of the thickness (a) of the part (A) to the thickness (b) of the part (B) [a/b] being in a range of 0.1 to 0.9 on a cross-section of the eccentric hollow conjugated continuous fiber, wherein in the cross-section, the thicknesses (a) and (b) are each defined as the longest distances from the circumference of the hollow to the facing circumference of the cross-section of the fiber in the parts (A) and (B), respectively;

wherein the eccentric hollow conjugated continuous fiber has the hollow eccentric towards part (A) and is crimped;

wherein the eccentric hollow conjugated continuous fiber has a fiber section that is a cross-section obtained by cutting the fiber perpendicular to a longitudinal axis, in which a ratio of a total length of the outer circumference of the part (A) to a total length of the outer circumference of the fiber section is lower than 40%; and wherein the eccentric hollow conjugated continuous fiber has a single fiber strength of 2 gf/d or greater.

2. A continuous-fiber nonwoven fabric comprising an eccentric hollow conjugated continuous fiber comprising a part (A), a part containing a higher melting-point thermoplastic resin (A), and a part (B), a part containing a lower melting-point thermoplastic resin (B), the parts (A) and (B) bonded to each other in a side by side arrangement, wherein:

the difference in melting point between the higher melting-point thermoplastic resin (A) and the lower melting-point thermoplastic resin (B) is 5° C. or greater;

the eccentric hollow conjugated continuous fiber has a part (A):part (B) proportion in the range of 5 to 30 weight %:95 to 70 weight %;

the eccentric hollow conjugated continuous fiber has a cross-section in which the thickness (a) of the part (A) is smaller than the thickness (b) of the part (B), a ratio of the thickness (a) of the part (A) to the thickness (b) of the part (B) [a/b] being in a range of 0.1 to 0.9on a cross-section of the eccentric hollow conjugated continuous fiber, wherein in the cross-section, the thicknesses (a) and (b) are each defined as the longest distances from the circumference of the hollow to the facing circumference of the cross-section of the fiber in the parts (A) and (B), respectively;

wherein the eccentric hollow conjugated continuous fiber has the hollow eccentric towards part (A) and is crimped;

wherein the eccentric hollow conjugated continuous fiber has a fiber section that is a cross-section obtained by cutting the fiber perpendicular to a longitudinal axis, in which a ratio of a total length of the outer circumference of the part (A) to a total length of the outer circumference of the fiber section is lower than 40%; and wherein the continuous-fiber nonwoven fabric has a bulkiness of 0.014 mm/(g/m$^2$)or higher wherein the bulkiness is a quotient obtained by dividing a thickness (mm) of the continuous-fiber nonwoven fabric by a basis weight (g/m$^2$of the continuous-fiber nonwoven fabric.

3. The eccentric hollow conjugated continuous fiber according to claim 1, wherein the higher melting-point thermoplastic resin (A) is a propylene polymer with a melting point of 155° C. or higher, and the lower melting-point thermoplastic resin (B) is a propylene copolymer with a melting point or a softening point of 150° C. or lower.

4. A mixed-continuous-fiber nonwoven fabric comprising an eccentric hollow conjugated continuous fiber containing a part (A), a part containing a higher melting-point thermoplastic resin (A), and a part (B), a part containing lower melting-point thermoplastic resin (B), the parts (A) and (B) bonded to each other in a side by side arrangement, and a non-crimped continuous fiber, wherein:

the difference in melting point between the higher melting-point thermoplastic resin (A) and the lower melting-point thermoplastic resin (B) is 5° C. or greater;

the eccentric hollow conjugated continuous fiber has a part (A):part (B) proportion in the range of 5 to 30 weight %:95 to 70 weight %;

the eccentric hollow conjugated continuous fiber has a cross-section in which the thickness (a) of the part (A) is smaller than the thickness (b) of the part (B), a ratio of the thickness (a) of the part (A) to the thickness (b) of the part (B) [a/b] being in a range of 0.1 to 0.9on a cross-section of the eccentric hollow conjugated continuous fiber;

wherein the eccentric hollow conjugated continuous fiber has the hollow eccentric towards part (A) and is crimped;

wherein the eccentric hollow conjugated continuous fiber has a fiber section that is a cross-section obtained by cutting the fiber perpendicular to a longitudinal axis, in which a ratio of a total length of the outer circumference of the part (A) to a total length of the outer circumference of the fiber section is lower than 40%; and wherein the eccentric hollow conjugated continuous fiber has a single fiber strenght of 2 gf/d or greater.

5. A continuous-fiber nonwoven fabric laminate comprising the continuous-fiber nonwoven fabric according to claim 2.

6. A paper diaper comprising the eccentric hollow conjugated continuous fiber according to claim 1.

7. A sheet for a barrier leg cuff comprising the eccentric hollow conjugated continuous fiber according to claim 1.

8. A sanitary napkin comprising the eccentric hollow conjugated continuous fiber according to claim 1.

9. The eccentric hollow conjugated continuous-fiber nonwoven fabric according to claim 2, wherein the higher melting-point thermoplastic resin (A) is a propylene polymer with a melting point of 155° C. or higher, and the lower melting-point thermoplastic resin (B) is a propylene copolymer with a melting point or a softening point of 150° C. or lower.

10. A continuous-fiber nonwoven fabric laminate comprising the mixed-continuous-fiber nonwoven fabric according to claim 4.

11. A paper diaper comprising the continuous-fiber nonwoven fabric according to claim 2.

12. A paper diaper comprising the mixed-continuous-fiber nonwoven fabric according to claim 4.

13. A sheet for a barrier leg cuff comprising the continuous-fiber nonwoven fabric according to claim 2.

14. A sheet for a barrier leg cuff comprising the mixed-continuous-fiber nonwoven fabric according to claim 4.

15. A sanitary napkin comprising the continuous-fiber nonwoven fabric according to claim 2.

16. A sanitary napkin comprising the mixed-continuous-fiber nonwoven fabric according to claim 4.

17. The eccentric hollow conjugated continuous fiber according to claim 1, which has 29.5 or more crimps per 25 mm.

18. The continuous-fiber nonwoven fabric according to claim 2, wherein the eccentric hollow conjugated continuous fiber has 29.5 or more crimps per 25 mm.

19. The mixed-continuous-fiber nonwoven fabric according to claim 4, wherein the eccentric hollow conjugated continuous fiber has 29.5 or more crimps per 25 mm.

20. The continuous-fiber nonwoven fabric according to claim 2, wherein the eccentric hollow conjugated continuous fiber has a single fiber strength of 2 gf/d or greater.

* * * * *